United States Patent [19]

Lindqvist et al.

[11] 4,140,145

[45] Feb. 20, 1979

[54] HIGH PRESSURE APPARATUS

[76] Inventors: Hakan Lindqvist, Ekenstamsvagen 4; Lars G. Westman, Jenningsgatan 38, both of Robertsfors, Sweden

[21] Appl. No.: 860,732

[22] Filed: Dec. 13, 1977

[30] Foreign Application Priority Data

Dec. 15, 1976 [ZA] South Africa ..... 76/7475

[51] Int. Cl.[2] ..... B30B 11/32

[52] U.S. Cl. ..... 425/77; 425/451.5

[58] Field of Search ..... 425/77, 451.5, 451.6, 425/592, 593, DIG. 220, DIG. 222

[56] References Cited

U.S. PATENT DOCUMENTS

| | | | |
|---|---|---|---|
| 2,233,354 | 2/1941 | Thilenius | 425/DIG. 222 |
| 3,384,926 | 5/1968 | Tsujii | 425/77 |
| 3,609,816 | 10/1971 | McDonald | 425/DIG. 222 |
| 3,618,164 | 11/1971 | Rietmann | 425/77 |

*Primary Examiner*—J. Howard Flint, Jr.

*Attorney, Agent, or Firm*—Cushman, Darby & Cushman

[57] ABSTRACT

A press with oppositely acting rams which has the features of maintaining parallel press plattens during operation and also good alignment of the plattens in relation to the central pressure axis. Two closed links are positioned side by side and each link carries a platten support cantilevered into the cavity of the other link and the rams act between the cantilever portion and the link into which it is cantilevered. In one form the links are closed while in the other form the links are C-shaped to provide a gap press.

6 Claims, 6 Drawing Figures

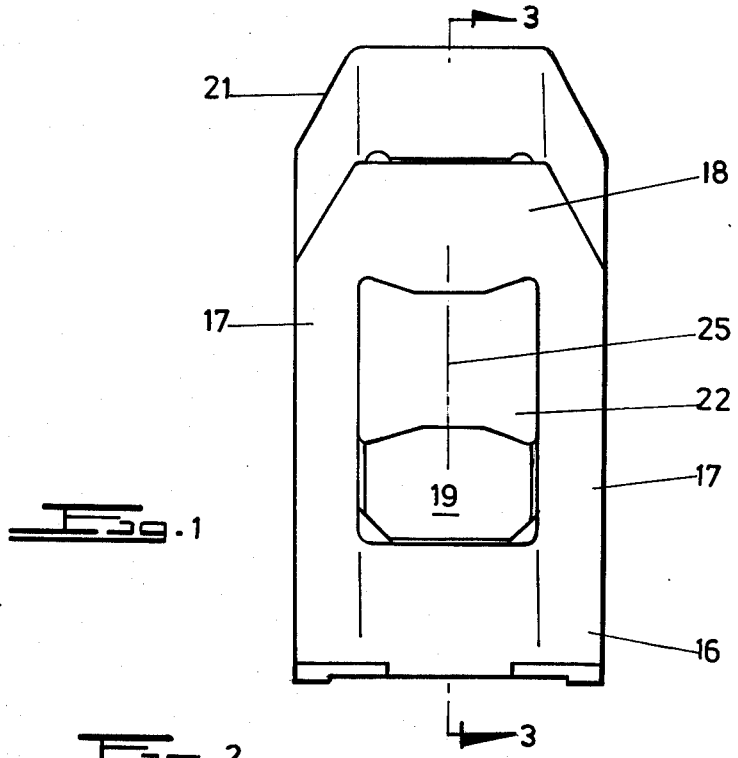
Fig. 1
Fig. 2
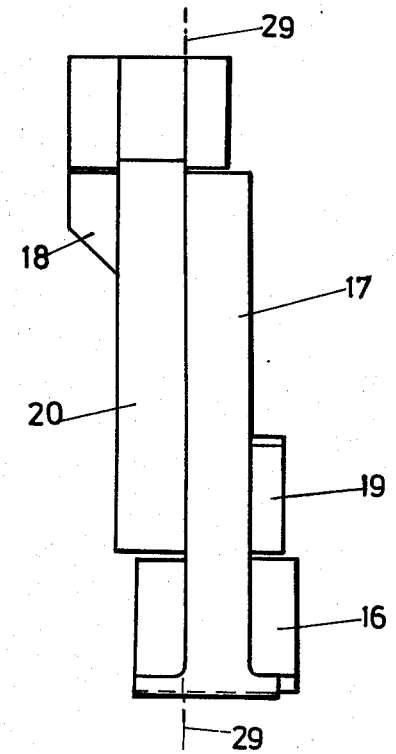
Fig. 3
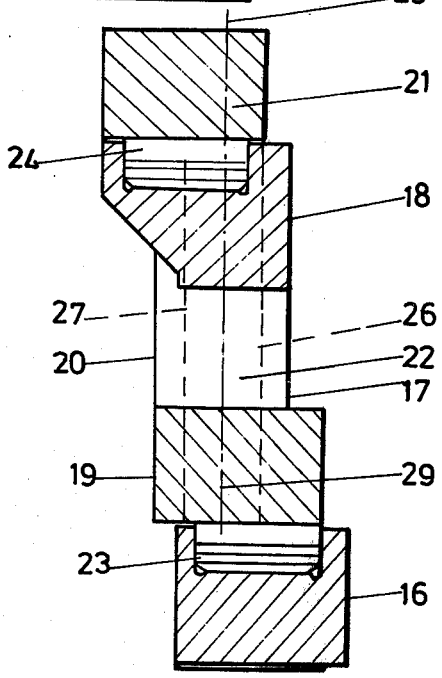

HIGH PRESSURE APPARATUS

BACKGROUND TO THE INVENTION

This invention relates to high pressure apparatus and more particularly to hydraulic presses.

Hydraulic presses have already been proposed in which two plattens move relatively together under the influence of hydraulic rams positioned on opposite sides of the space between the plattens. Such proposals are, for example, contained in DOS 1 627 445, 1 627 802 and 1 627 803. In these proposals forces are transmitted by means of laminations which are flat plates intercallated together with one plate moving in a relative direction opposite to the other. It is a complicated procedure to make these laminations and to assemble them together in such a way that they transmit the required forces in the required manner.

SUMMARY OF THE INVENTION

High pressure apparatus according to the invention comprises first and second plattens which may move relatively together and in parallelism to decrease a space between them, the space having a central pressure axis, first and second supports carrying the plattens, first and second abutments sandwiching the plattens with their supports between them with the first abutment facing the first support, at least one hydraulic ram acting between each support and the abutment facing it, first and second rigid links linking the first support and the second abutment and the second support and the first abutment respective characterised by:

- platens and supports which are cantilevered off the link ends; links which act in spaced apart and parallel planes to either side of the pressure axis of the space and in action transfer reaction forces from the rams along tension lines eccentric to and equidistant from the pressure axis;
- rams producing resultant forces on ram axes between cantilevered support and abutment ends; and
- guide means between each abutment and the support facing it to guide the plattens to move in parallelism.

The links are preferably positioned side by side in abutting sliding engagement with one another.

In the form of the invention each link has two limbs straddling the space and in such a case it is preferred that one ram element be fast with a support and the other fast with an abutment with the ram elements serving as guide means.

According to another aspect of the invention high pressure apparatus comprises two plattens between which a pressure space is formed, two closed links interlinked with opposed inside surfaces carrying the plattens and rams between them and the other inside surfaces characterised in that the links are positioned side by side in abutting sliding engagement with one another and each platten is cantilevered out of its link for the axis of the space to lie in the plane between the links. According to a further aspect the apparatus comprises two plattens between which a pressure space is formed, two links carrying the plattens and providing abutments spaced from the plattens with rams between the plattens and the abutments, characterised in that the links are C-shaped and positioned side by side in abutting sliding engagement with one another, each platten and abutment is cantilevered out of its link for the space to be halved by a first plane between the links and also by a second plane at right angles to the first plane, the leg of the C in each case being positioned on one side of the second plane and the rams being positioned on the opposite side of the second plane and the rams acting with the major resultant force parallel to the first plane, and means between the plattens and the abutments to guide them to move relatively in parallelism.

DESCRIPTION OF THE DRAWINGS

FIG. 1 is a front elevation of a press according to the invention,

FIG. 2 is a side elevation of FIG. 1,

FIG. 3 is a section on the line 3—3 of FIG. 1,

DESCRIPTION OF PREFERRED EMBODIMENTS

Figure 4:
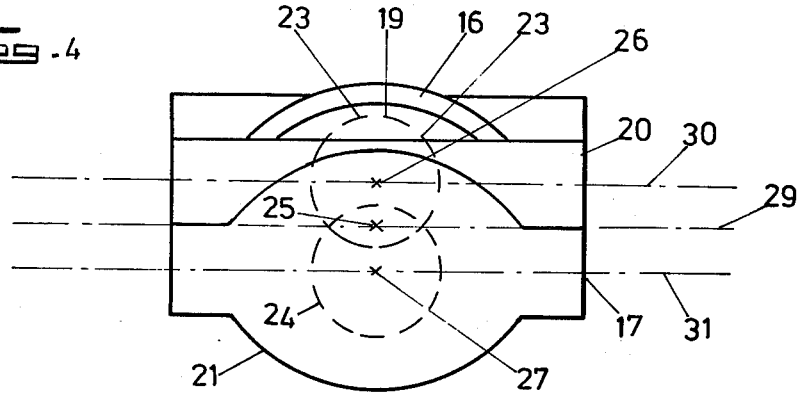
FIG. 4 is a plan of FIG. 1.
Figure 5:
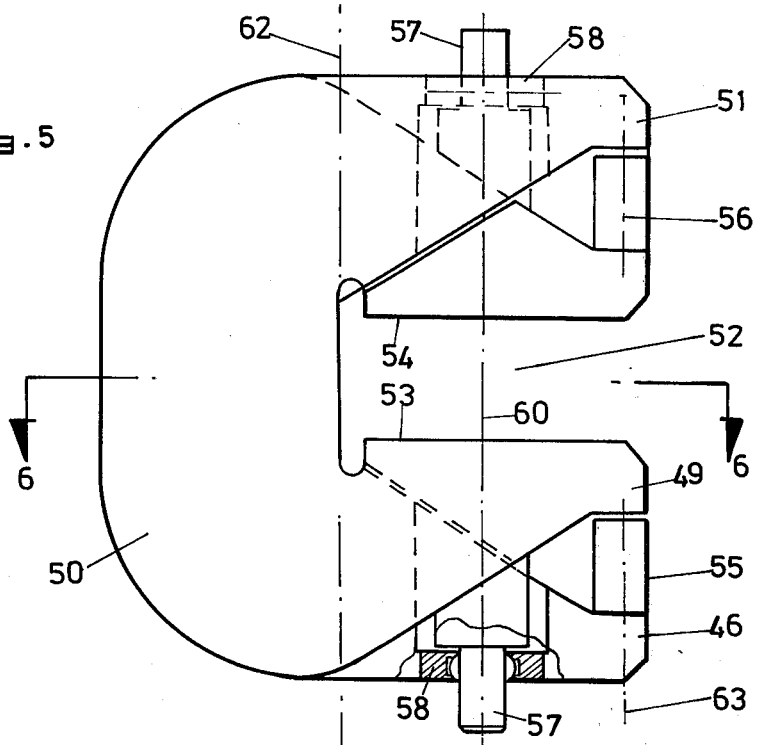
FIG. 5 is a side elevation of another press according to the invention.

FIGS. 1 to 4 illustrate an embodiment of the present invention suitable for use on capsules and the like. FIGS. 4 and 5 show an embodiment suitable for the case where access from three sides is required, e.g. when coining the edges of large sheets.

In FIGS. 1 to 4 a press suitable for use in diamond synthesis is illustrated. It has a base 16 connected to an upper platten 18 by means of link limbs 17. The other component comprises a bottom platten 19 connected to a top abutment 21 by means of link limbs 20. A space 22 is defined between the plattens 18 and 19 and it has a pressure axis along the dotted line 25 (FIG. 1) and in a plane 29 (FIGS. 2-4).

Between the members 16 and 19 and the members 18 and 21 there are two hydraulic rams with ram pistons 23 and 24. The pistons enter into ram cylinders formed in the members 16 and 18 respectively. The ram pistons 23 and 24 are fast with the members 19 and 21 respectively. Since the ram diameters are large the interengaging piston and cylinder surfaces provide adequate guide surfaces for the press.

The rams act on lines 26 and 27 which are spaced equidistantly from the plane 29 (FIG. 3) and the lines 26 and 27 lie in planes 30 and 31 (FIG. 4) which are parallel to the plane 29.

In use a workpiece is placed into the space 22 between the plattens 18 and 19 and is positioned with its axis on the line 25. The rams are actuated by the admission of pressure fluid and the workpiece is acted upon. As long as the rams produce the same force and the forces act on the lines 26 and 27, there is no imbalance of forces. The two frames composed of the members 16, 17 and 18 and the members 19, 20 and 21 respectively move side by side and are guided by the rams to keep the platten faces parallel.

The force acting on the workpiece is the sum of the forces produced by the rams 23 and 24.

For diamond synthesis an apparatus of the well known belt type may be positioned in the space 22 in a well known manner.

Figure 6:
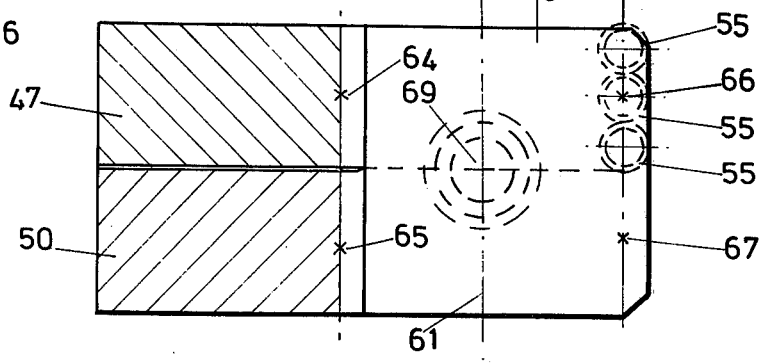
FIG. 6 is a sectional plan on the line 6—6 in FIG. 5.

The press of FIGS. 5 and 6 could be called a "gap" press. As shown, there is a first C-shaped element comprising a base limb 46, an upwardly extending link limb 47 and a platten limb 48. Side by side with the first element is a second element which has an abutment limb 51, a link limb 50 and a platten limb 49.

A space 52 is defined between surfaces 53 and 54 of the platten limbs 48 and 49. As can be seen from FIG. 6 the surface 53 and the platten limb 49 extend for the full width of the press. Likewise the surface 54 and the limb 48 extend for the full width of the press. The surfaces 53 and 54 are thus cantilevered out of the links that carry them.

Hydraulic rams 55 act between the limbs 46 and 49 and rams 56 act between the limbs 51 and 48. As shown there are three rams in a group, but they could be replaced by a single ram or there could be only two rams in a group.

The members 49 and 48 are formed with bosses which carry guide shafts 57 and which in turn engage in suitable sliding bearings 58 in the members 46 and 51. The axes of the shafts 57 correspond with the pressure axis 60 of the press.

The axis 60 lies in a plane 6 (FIG. 6). The limbs 50 and 47 can be considered to transmit tension forces in the plane 62 with resultants in that plane along the lines 64 and 65. The rams 55 and 56 can be considered to act in a plane 63 with resultants in that plane along the lines 66 and 67.

If a workpiece is placed in the space 52 with its resultant force axis on the line 60, and each of the rams 55 and 56 produce the same force, the surfaces 53 and 54 will remain parallel and any side forces will be taken up by the guide shafts 57 in the bearings 58. For perfect balance of the side forces the rams 55 and 56 have to act in oblique planes, but in this case the rams have to be hinged between the members 46 and 49 and 48 and 51 respectively.

We claim:

1. High pressure apparatus comprising first and second plattens which may move relatively together and in parallelism to decrease a space between them, the space having a central pressure axis, first and second supports carrying the plattens, first and second abutments sandwiching the plattens with their supports between them with the first abutment facing the first support at least one hydraulic ram acting between each support and the abutment facing it, first and second rigid links linking the first support and the second abutment and the second support and the first abutment respectively characterised by:- plattens and supports which are cantilevered off the link ends; links which act in spaced apart and parallel planes to either side of the pressure axis of the space and in action transfer reaction forces from the rams along tension lines eccentric to and equidistant from the pressure axis;

rams producing resultant forces on ram axes between cantilevered support and abutment ends;

guide means between each abutment and the support facing it to guide the plattens to move in parallelism.

2. The apparatus claimed in claim 1 in which the links are positioned side by side by abutting sliding engagement with one another.

3. The apparatus claimed in claim 1 in which each link has two limbs straddling the space.

4. The apparatus claimed in claim 3 in which each ram has two elements telescoping together, one ram element is fast with a support and the other fast with an abutment and the ram elements serve as guide means.

5. High pressure apparatus comprising two plattens between which a pressure space is formed, two closed links interlinked with opposed inside surfaces carrying the plattens and rams between them and the other inside surfaces characterised in that the links are positioned side by side in abutting sliding engagement with one another and each platten is cantilevered out of its link for the axis of the space to lie in the plane between the links.

6. High pressure apparatus comprising two plattens between which a pressure space is formed, two links carrying the plattens and providing abutments spaced from the plattens with rams between the plattens and the abutments, characterised in that the links are C-shaped and positioned side by side in abutting sliding engagement with one another, each platten and abutment is cantilevered out of its link for the space to be halved by a first plane between the links and also by a second plane at right angles to the first plane, the leg of the C in each case being positioned on one side of the second plane and the rams being positioned on the opposite side of the second plane and the rams acting with the major resultant force parallel to the first plane, and means between the plattens and the abutments to guide them to move relatively in parallelism.

* * * * *